United States Patent [19]

Sakai et al.

[11] Patent Number: 4,878,087

[45] Date of Patent: Oct. 31, 1989

[54] IMAGE FORMING APPARATUS WITH JAM REMOVAL MECHANISM

[75] Inventors: Toshiyuki Sakai; Toshio Sakata, both of Osaka, Japan

[73] Assignee: Minolta Camera Kabushiki Kaisha, Osaka, Japan

[21] Appl. No.: 143,042

[22] Filed: Jan. 12, 1988

[30] Foreign Application Priority Data

Jan. 13, 1987 [JP] Japan ..... 62-6910

[51] Int. Cl.[4] ..... G03G 15/00; G03G 21/00; B65H 29/00; B65H 7/02

[52] U.S. Cl. ..... 355/207; 271/184; 271/258; 271/902; 355/313; 355/319

[58] Field of Search ..... 355/14 SH, 14 R, 35 H, 355/23, 24, 25; 271/184, 258, 263, 291, 303, 902

[56] References Cited

U.S. PATENT DOCUMENTS

| | | | |
|---|---|---|---|
| 3,645,615 | 2/1972 | Spear, Jr. . | |
| 3,989,371 | 11/1976 | Valentine . | |
| 4,017,173 | 4/1977 | Komori et al. . | |
| 4,073,585 | 2/1978 | Kobayashi et al. | 271/303 X |
| 4,123,155 | 10/1978 | Hubert . | |
| 4,173,410 | 11/1979 | Tabata et al. . | |
| 4,247,193 | 1/1981 | Kaneko et al. | 355/14 R |
| 4,253,759 | 3/1981 | Rattin . | |
| 4,365,886 | 12/1982 | Murakami et al. . | |
| 4,537,497 | 8/1985 | Masuda . | |
| 4,568,169 | 2/1986 | Wada et al. . | |
| 4,571,056 | 2/1986 | Tani et al. | 355/35 H X |
| 4,575,227 | 3/1986 | Ito et al. . | |
| 4,585,336 | 4/1986 | Tanaka . | |
| 4,627,711 | 12/1986 | Schron | 355/35 H X |
| 4,629,173 | 12/1986 | Hashimoto et al. | 355/24 X |
| 4,702,589 | 10/1987 | Ito . | |
| 4,743,945 | 5/1988 | Ito et al. . | |
| 4,750,020 | 6/1988 | Ishizu et al. | 355/14 SH |

FOREIGN PATENT DOCUMENTS

| | | | |
|---|---|---|---|
| 54-109445 | 8/1979 | Japan . | |
| 59-38760 | 3/1984 | Japan . | |
| 0218247 | 10/1985 | Japan | 271/258 |

*Primary Examiner*—A. T. Grimley
*Assistant Examiner*—E. J. Pipala
*Attorney, Agent, or Firm*—Burns, Doane, Swecker & Mathis

[57] ABSTRACT

An image forming apparatus having a primary passage extending from a feeding unit which stores sheets up to a discharge tray which receives sheets with images formed thereon through an image forming unit which forms images on the sheet, and a secondary passage for returning each sheet which has been image-formed within the image forming unit to an upstream end of the primary passage from a downstream end thereof to form another image on the already image-formed side of the sheet or on the opposite side thereof. The secondary passage is formed so that in the event of jam or sheet therein, a portion of the secondary passage is exposed to the exterior by means of a guide plate capable of being opened and closed. Jam of sheet in the secondary passage is detected by a sensor and the jammed sheet is reverse fed up to the above guide plate by a drive which is for the conveyance of sheet in the secondary passage, then the guide plate is opened to permit removal of the thus reverse-fed sheet to the exterior of the apparatus.

3 Claims, 5 Drawing Sheets

IMAGE FORMING APPARATUS WITH JAM REMOVAL MECHANISM

BACKGROUND OF THE INVENTION

1. Field of the Invention

The present invention relates to an image forming apparatus such as a copying machine and more particularly to an image forming apparatus having a re-feeding unit for feeding sheet with an image formed on one side to a transfer unit to form another image on the sheet.

2. Description of the Prior Art

To meet the recent requirement for multifunction of a copying machine, there has recently been used a copying machine having a composite copying function capable of effecting transfer of images a plural number of times onto one side of a single sheet, or a copying machine having a both-side copying function capable of effecting transfer of images onto both the surface and the back. Further, in U.S. Ser. No. 883,144 filed on July 8, 1986 there is disclosed a copying machine having both a composite copying function of making transfer of images in plural number of times onto one side of sheet and a both-side copying function of making transfer of images onto both sides of sheet.

A copying machine having any of the above-mentioned functions is provided with a primary passage for feeding each sheet from the interior of a feeding section which contains copying sheets up to a discharge section through a transfer section and a fixing section and also provided with a secondary passage contiguous to the primary passage and formed in a re-feeding section which is for returning the sheet with an image formed thereon past the fixing section again to the transfer section.

Since the sheet fed into the secondary passage has once passed through the fixing section, it is in a curled state with heat or its water content or stiffness has been changed as compared with the original sheet, resulting in that jam of sheet is more likely to occur in the secondary passage.

According to the prior art, in the event of a jam in the sheet feeding passage, the occurrence and position of the jam are detected by a sheet position detecting sensor and a timer which detects the time during which the sheet is detected by the sensor, and the jam position is indicated by an indicator. In order to remove the sheet which is causing the jam to the exterior of the copying machine, the sheet conveying path is capable of being opened. The operator puts his hand into the jam portion of the interior of the copying machine and removes the sheet to the exterior.

Consequently, a conventional copying machine of this type becomes larger in size in order to ensure the working space of the operator. Particularly, recent copying machines are compact, so in the case where a secondary passage for effecting re-feed is provided, there is no extra space for opening the said passage in the interior of the machine, resulting in that it is becoming more and more difficult to deal with the jam of sheet in the secondary passage.

SUMMARY

It is an object of the present invention to provide a small-sized image forming apparatus having a re-feed unit for feeding sheet with an image formed on one side thereof again up to a transfer section to form another image thereon.

It is another object of the present invention to provide an image forming apparatus having motor-driven rollers for returning sheet which causes a jam in the re-feed unit to an upstream end of the re-feed unit.

It is a further object of the present invention to provide an image forming apparatus having a sheet removing area for discharging to the exterior the sheet which has caused jam and returned.

In accordance with the present invention there is provided an image forming apparatus for forming images on a single sheet in plural number of times by feeding the sheet again to an image forming unit after an image is formed on one side of the sheet by said image forming unit, said image forming apparatus including: an apparatus body in which said image forming unit is incorporated, said apparatus body having a feeding unit which stores sheets fed into the image forming unit and a discharge section which receives sheets with images formed thereon; a primary passage formed within said apparatus body to guide each sheet from the interior of said feeding unit to said discharge section through said image forming unit; a secondary passage branching from a downstream end of said primary passage and extending up to an upstream end of the same passage to guide each sheet which has passed said image forming unit again up to said image forming unit, said secondary passage having a sheet removing area which functions to expose the interior of the secondary passage to the exterior of the apparatus body to permit the removal of the sheet present in the interior; a detecting means disposed in said secondary passage to detect a jammed sheet present in the secondary passage; a re-feed unit disposed within said apparatus body, forming a part of said secondary passage and provided with a drive means for driving each sheet present in the secondary passage forward toward the upstream end of said primary passage and also driving it backward toward the downstream end of the primary passage; and a control means which controls said drive means so that when said detecting means detects jam in the secondary passage of said re-feed unit, the jam sheet is moved backward up to said sheet removing area.

DESCRIPTION OF THE PREFERRED EMBODIMENT

Figure 1:
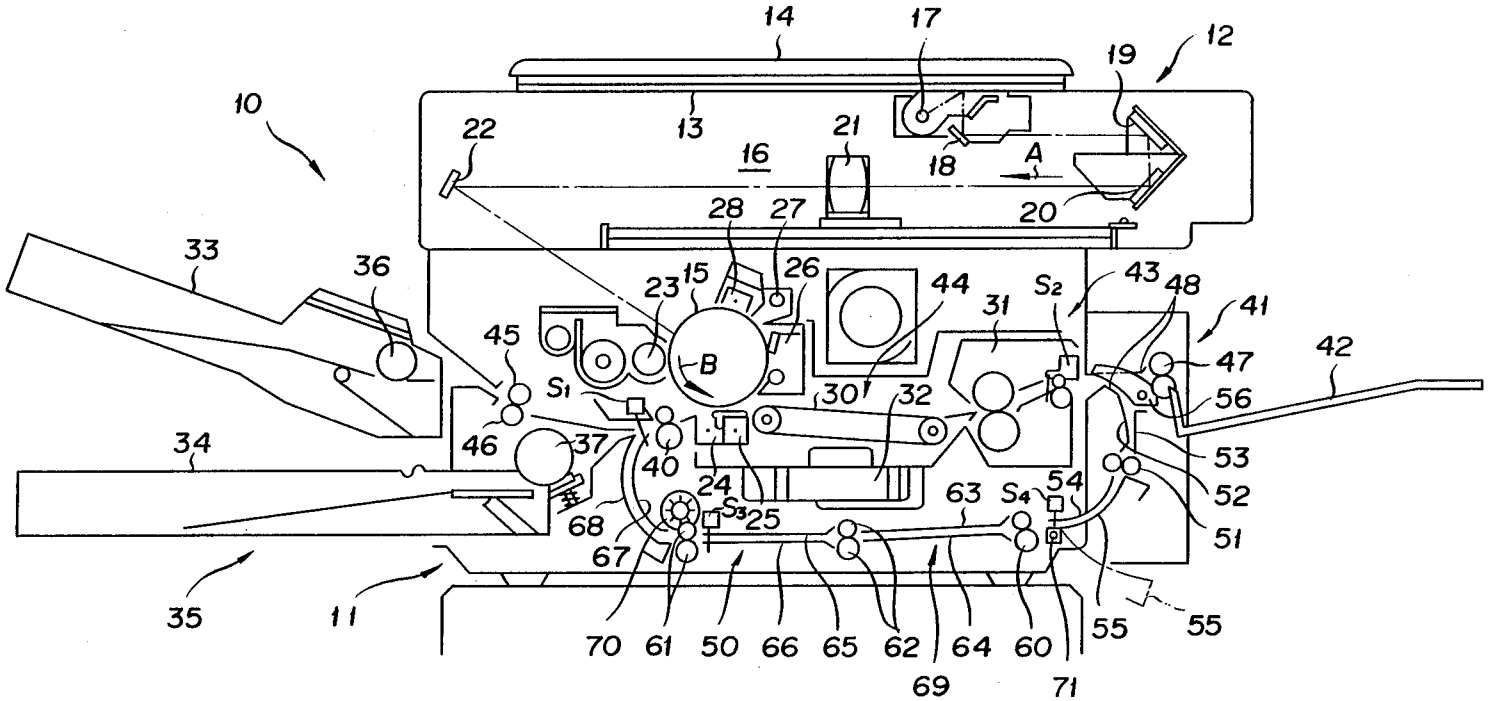
FIG. 1 is a schematic view of an image forming apparatus according to an embodiment of the present invention.

A copying machine according to a preferred embodiment of the present invention is based on electrophotography, whose body indicated at 10 comprises a lower body 11 and an upper body 12 pivotably mounted to the lower body 11. The upper body 12 of the copying machine body 10 is provided with a document bearing glass table 13 and a cover 14 for the table 13, the cover 14 capable of being opened and closed.

An image forming optical system 16 for forming an eletrostatic latent image on a photosensitive drum 15 mounted to the upper body 12 is well known, including a light source 17, mirrors 18, 19 and 20, a lens 21 and a mirror 22. It scans the document surface in the direction indicated by arrow A. A magnetic brush type developing device 23 for adhering toner to the electrostatic latent image formed on the photosensitive drum 15 is mounted to the upper body 12 in a position adjacent to the drum 15 which rotates in the direction of arrow B in FIGS. 1 and 2. Further, a transfer charger 24 for transferring toner to sheet and a separation charger 25 for separating the sheet from the photosensitive drum 15 are mounted to the lower body 11 in positions below the drum 15. The residual toner remaining on the outer peripheral surface of the photosensitive drum 15 after the transfer of the toner onto the sheet is removed by a cleaner 26. An eraser lamp 27 and a charger 28 are mounted to the upper body 12 in positions above the photosensitive drum 15.

The sheet after completion of the transfer is conveyed to a fixing device 31 mounted to the lower body 11 by means of an endless belt 30 mounted in the lower body 11. A suction pump 32 is mounted to the lower body 11 in a position below the belt 30 so that the sheet being conveyed on the belt 30 is stuck to the belt at a negative pressure.

To the left end portion of the lower body 11 are removably attached two feed cassettes 33 and 34 which contain copying sheets of different sizes. The feed cassettes 33 and 34 constitute a feed unit 35. The sheets in the feed cassette 33 are fed one by one by means of a feed roller 36 and the sheets in the feed cassette 34 also fed one by one by means of a feed roller 37. The feed rollers 36 and 37 are rotated selectively.

A pair of timing rollers 40 are mounted to the lower body 11 in positions adjacent to the transfer charger 24 to feed each sheet from the interior of either the feed cassette 33 or the cassette 34 to between the photosensitive drum 15 and the transfer charger 24, separation charger 25 in synchronism with the electrostatic latent image formed on the outer peripheral surface of the photosensitive drum 15. Onto the sheet thus fed by the timing rollers 40 is transferred a toner image by electric discharge of the transfer charger 24 and the sheet is then separated from the photosensitive drum 15 by virtue of AC discharge of the separation charger 25 and its own stiffness. Subsequently, the sheet is fed to the fixing device 31 while being stuck onto the belt 30 by the suction force of the suction pump 32 and the toner is fixed thereto under heating.

Figure 2:
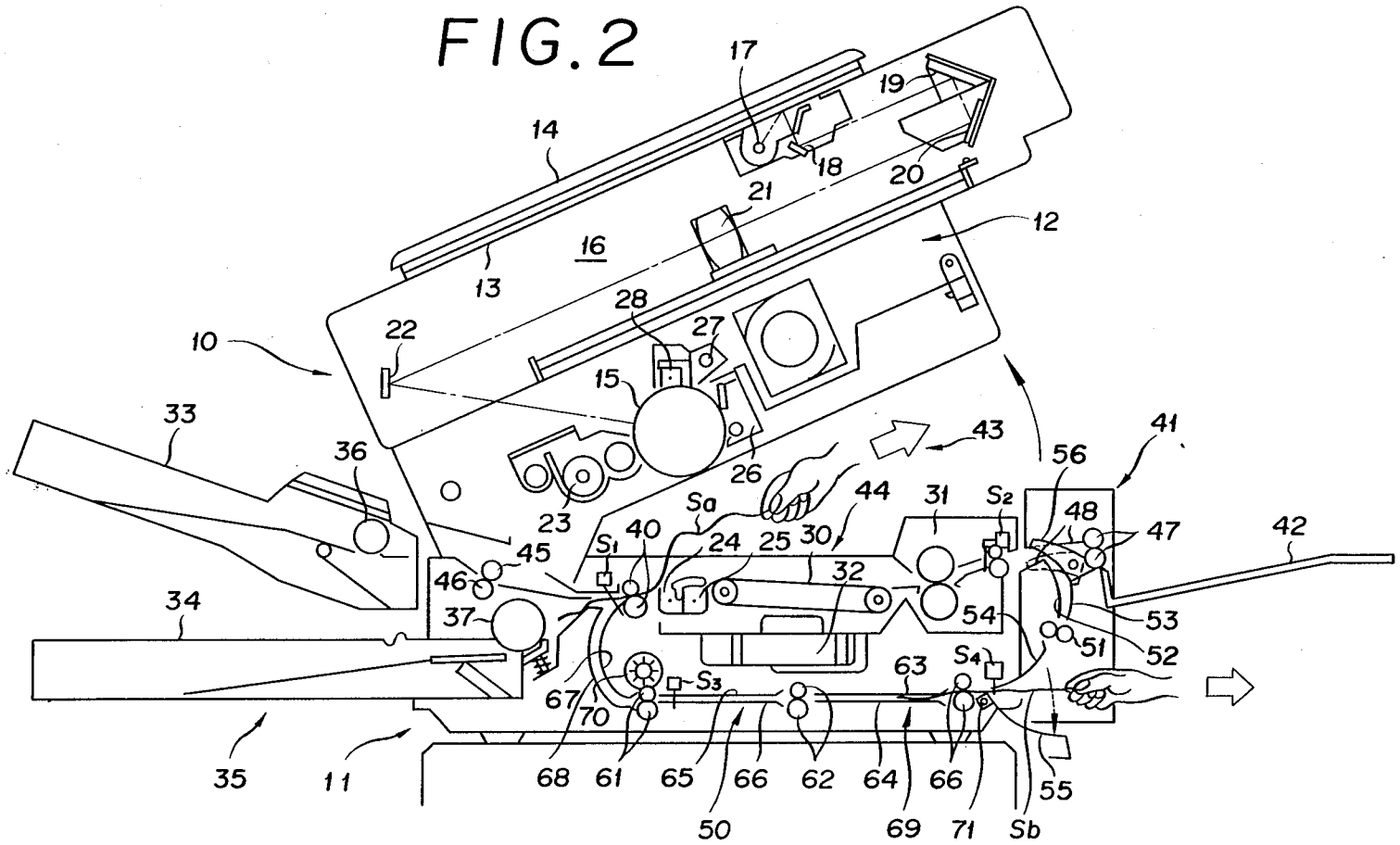
FIG. 2 is a schematic view thereof with an upper body opened.

A sheet reversing unit 41 is attached to the right end of the lower body 11 in FIGS. 1 and 2. Attached to the sheet reversing unit 41 is a discharge tray 42 for receiving therein the sheet which has been subjected to the heat fixing in the fixing device 31.

A known type of an image forming unit 43 for forming an image on the sheet is constituted by the developing device 23, the photosensitive drum 15, the fixing device 31, etc. and the section from the timing rollers 40 in the image forming unit 43 up to the sheet reversing unit 41 serves as a primary passage 44.

Rollers 45 and 46 for conveying the sheet from the feed cassette 33 up to the timing rollers 40 are mounted to the lower body 11, and the upper body 12 is pivotable about the roller 45. With the upper body 12 pivoted to open as shown in FIG. 2, it is possible to effect maintenance and inspection of each component of the image forming unit 43 and sheet Sa which is causing clogging in the primary passage 44 can be removed.

Discharge rollers 47 for the delivery of the heat-fixed sheet to the discharge tray 42 are mounted in the sheet reversing unit 41, and guide plates 48 for guiding the sheet from the fixing device 31 to the discharge rollers 47 are mounted in the sheet reversing unit 41.

In the lower body 11 is mounted a re-feed unit 50 in a position below the image forming unit 43 for returning the sheet which has passed through the fixing device 31 again into the primary passage 44 formed within the image forming unit 43.

Within the sheet reversing unit 41 are provided a pair of feed rollers 51, guide plates 52 and 53 which are positioned between the feed rollers 51 and guide plates 48, and curved guides 54 and 55 which provide a connection between the feed rollers 51 and the re-feed unit 50. Further, for guiding the sheet which has passed through the fixing device 31 to the discharge tray 42, a change-over pawl 56 is provided within the sheet reversing unit 41 so as to be pivotable between a close position in which it is kept away from the passage defined by the guide plates 48 as indicated by a phantom line in FIG. 2 and a open position in which it projects into the passage defined by the guide plates 48 to close the passage.

For an image-formed sheet in the case of forming an image on one side of the sheet only once, or for a sheet which has been subjected to all of image forming steps in the case of forming images on one side of the sheet in plural number of times, the change-over pawl 56 is turned to the close position indicated by a phantom line in FIG. 2, whereby the sheet is discharged onto the discharge tray 42 with the discharge rollers 47. On the other hand, where there is made composite copying in which images are formed on one side of sheet in plural number of times, the sheet is fed to the re-feed unit 50 through the passage between the guide plates 52 and 53 and further through the passage between the guide plates 54 and 55 by turning the change-over pawl 56 to its open position shown in FIGS. 1 and 2.

The re-feed unit 50 has a pair of feed rollers 60 mounted to the lower body 11 in positions adjacent to the guide plates 54 and 55, a pair of feed rollers 61 mounted to the lower body 11 in positions below the timing rollers 40, and a pair of feed rollers 62 positioned between those rollers. Thus, it has three pairs of feed rollers. Between the feed rollers 60 and 62 are provided guide plates 63 and 64 at a predetermined spacing to guide the sheet therebetween, while between the feed rollers 62 and 61 are disposed guide plates 65 and 66 at a predetermined spacing to guide the sheet therebetween. Further, between the feed rollers 61 and the timing rollers 40 are disposed curved guide plates 67 and 68 in spaced relation to each other at a predetermined spacing to guide the sheet therebetween.

A secondary passage 69 which branches from the downstream end of the primary passage 44 and reaches the upstream end thereof is formed by the passages formed between the above guide passages and extending from the passage defined by the guide plates 52 and 53 up to the passage defined by the guide passages 67 and 68. The secondary passage 69 guides the sheet which has passed through the fixing device 31, toward the timing rollers 40. The feed of the sheet in the secondary passage 69 in the re-feed unit 50 is effected by means of a motor 70 which is mounted within the lower body 11 and connected to the feed rollers 60, 61 and 62 to drive those rollers.

The motor 70 is usually driven forward to advance the sheet in the secondary passage 69 toward the timing rollers 40. But in the event the sheet causes jam or clog in the secondary passage 69, the motor 70 is driven in reverse to move the sheet backward to the gap between the guide plates 54 and 55 which gap serves as a sheet removing area.

The guide plate 55 located in the lower position relative to the guide plate 54 is pivotable about a pin 71 mounted to the lower body 11. When the guide plate 55 is turned up to its position shown in FIG. 2 to open the secondary passage 69, the sheet causing the jam, indicated at Sb, which has been moved backward is removed.

A sensor S1 is disposed upstream of the timing rollers 40 in a position adjacent thereto to detect the position of sheet in the primary passage 44 or the secondary passage 69. Further, a sensor S2 is disposed at the outlet portion of the fixing device 31 and a sensor S3 is disposed at the downstream end of the re-feed unit 50, while a sensor S4 is disposed at the upstream end of the same unit. The sensors S1 to S4 are each constituted by a limit switch which turns ON upon arrival of the sheet front end at the switch and turns OFF upon arrival of the sheet rear end at the switch.

Figure 3:
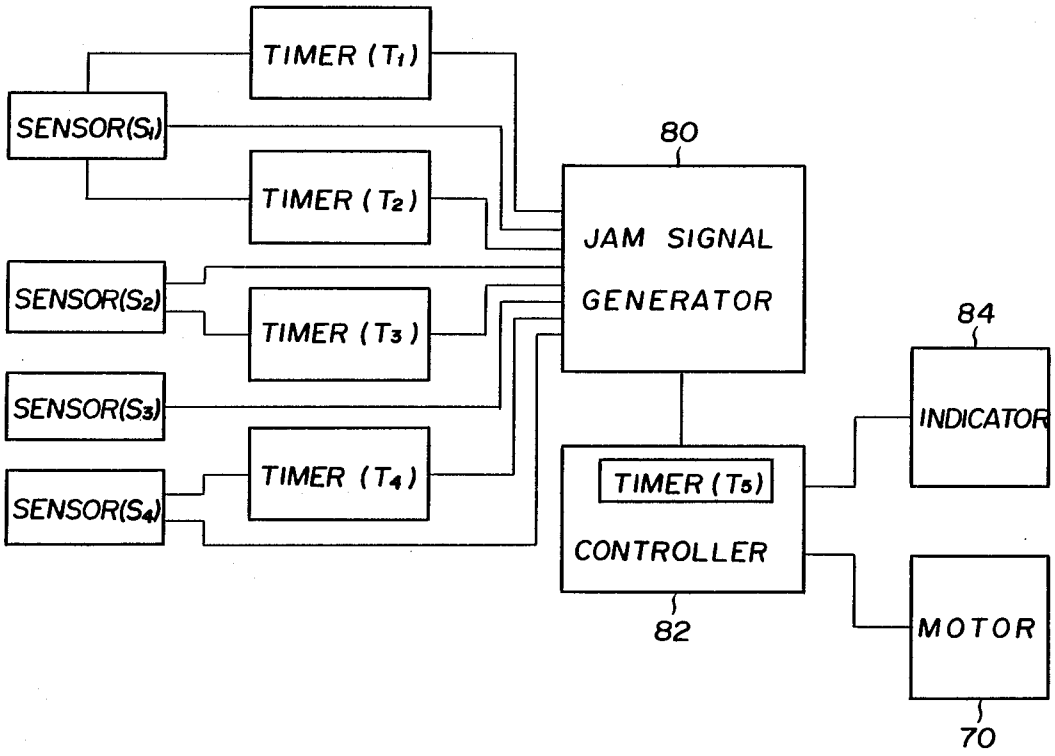
FIG. 3 is a block diagram showing a control means for driving a motor.

As shown in FIG. 3, which is a block diagram of a control section, the sensor S1 is connected to timers T1 and T2, and the sensors S2 and S4 are connected to timers T3 and T4, respectively, which start operation upon detection of sheet by the sensors. The timers T1 to T4 are each set to a time that is a little longer than the conveyance time corresponding to the sheet size required for the rear end of the sheet to pass any of the sensors S1, S2, and S4 which set the timer, after arrival of the front end thereof at the sensor. The said conveyance time differs depending on the sheet length. The sensors S1, S2, and S4, and the timers T1–T4 are connected to a jam signal generator 80 which detects a jam on the basis of signals provided from those sensors and timers. Thus, signals on the position of sheet which is passing through the primary passage 44 or the secondary passage 69 are input to the jam signal generator 80 and time-up signals are also input to the same generator from the timers. The sensor S3 is connected to the jam signal generator 80 so as to detect sheet present in the secondary passage 69.

The jam signal generator 80 is connected to a controller 82 for controlling the operation of the motor 70 which drives three pairs of rollers 60, 61 and 62 for the conveyance of sheet within the re-feed unit 50 and the operation of an indicator 84 which indicates in which portion of the image forming unit there occurred jam. The controller 80 has a timer T5 to which is set a reverse feed time for a jammed sheet. It not only provides a signal indicative of the jam position to the indicator 84 on the basis of a signal provided from the jam signal generator 80 but also makes controller 80 rotate the motor 70 in reverse only for the period of time set to the timer T5 to thereby convey the jammed sheet up to the passage formed between the guide plates 54 and 55.

Figure 4:
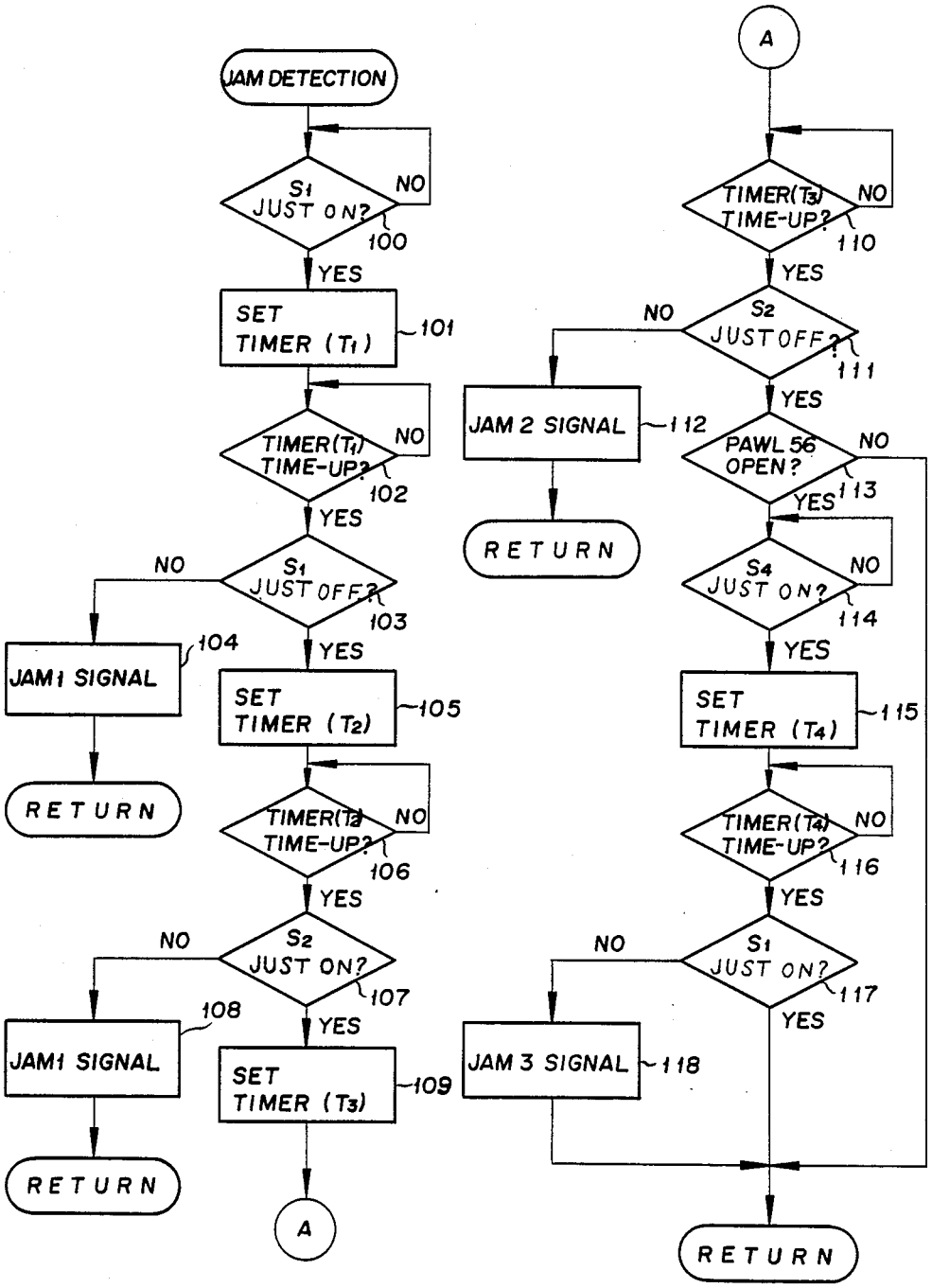
FIGS. 4 and 5 are each a flow chart showing a control process.
Figure 5:
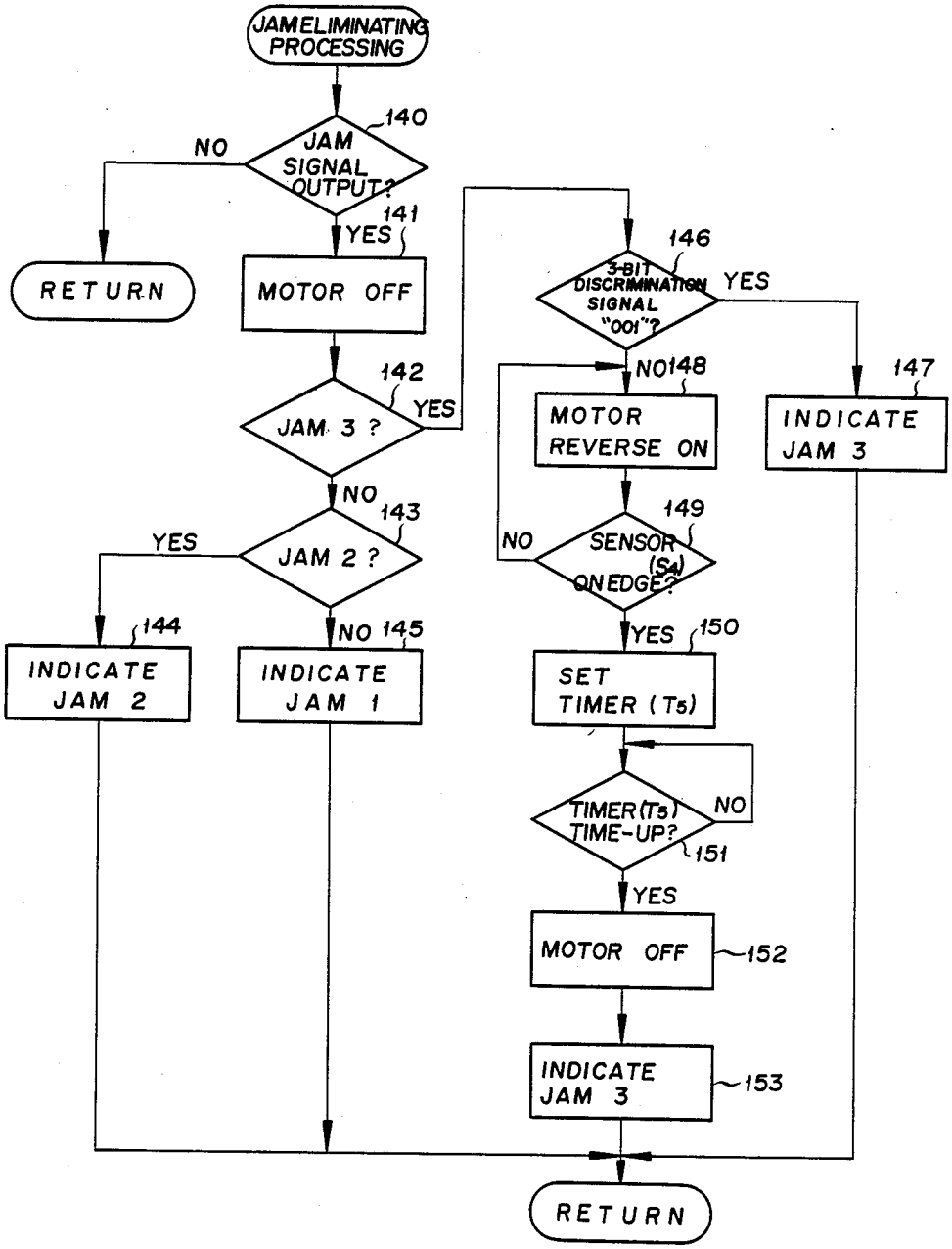

The following description is now provided about the control procedure for the detection of jam a and the jam eliminating processing which are performed in the controller of the image forming apparatus of the present invention, with reference to the operation flow charts of FIGS. 4 and 5.

FIG. 4 is an operation flow chart in the foregoing jam detection. First, in step 100 there is made a judgment as to whether the sensor S1 is just turned on or not. As a result, if it is judged that the front end of sheet has reached the sensor S1, the timer T1 is set in step 101. Then, if count-up of the timer T1 is confirmed in step 102, judgment is made in step 103 as to whether the sensor S1 is just turned off or not. The result is NO if the rear end of the sheet has not passed the sensor S1, then execution passes to step 104, in which the jam signal generator 80 provides a jam signal Jam 1 to the controller 82 and thereafter execution returns to a main routine (not shown). On the other hand, the result of the judgment in step 103 is YES if the rear end of the sheet has passed the sensor S1 and in this case the timer T2 is set in step 105. Then, if count-up of the timer T2 is confirmed in step 106, judgment is made in step 107 as to whether the sensor S2 is just turned on or not. The result is NO if the front end of the sheet has not reached the sensor S2 and in this case execution passes to step 108, in which the jam signal generator 80 provides a jam signal Jam 1 to the controller 82 and thereafter execution returns to the main routine. On the other hand, if the sheet front end has arrived at the sensor S2, the result of the judgment in step 107 is YES and in this case the timer T3 is set in step 109. Then, if count-up of the timer T3 is confirmed in step 110, judgment is made in step 111 as to whether the sensor S2 is just turned off or not. The result is NO if the rear end of the sheet has not passed the sensor S2 and in this case execution passes to step 112, in which the jam signal generator 80 provides a jam signal Jam 2 to the controller 82 and thereafter execution returns to the main routine. On the other hand, the result of the judgment in step 111 is YES if the sheet rear end has passed the sensor S2. In this case, judgment is made in step 113 as to whether the change-over pawl 56 is open as shown in FIGS. 1 and 2 or not, that is, whether the sheet has been subjected to the first copying in a composited copying mode or not, and if the result of this judgment is YES, judgment is made in step 114 as to whether the sensor S4 is just turned on or not. As a result, if it is judged that the front end of the sheet has arrived at the sensor S4, the timer T4 is set in step 115. Then, if the count-up of the timer T4 is confirmed in step 116, judgment is made in step 117 as to whether the sensor S1 is just turned on or not. The result is NO if the sheet rear end has not passed the sensor S1 and in this case execution passes to step 118, in which the jam signal generator 80 outputs a jam signal Jam 3 to the controller 82 and thereafter execution returns to the main routine. If the result of the judgment in step 117 is YES, this means that the conveyance of the sheet has been effected without causing jam, so the above jam detecting processing is terminated and execution returns to the main routine.

When the jam signal Jam 3 is output from the jam signal generator 80 in the step 118, the controller 82 checks whether the each of sensors S1, S3 and S4 are on or off through the jam signal generator 80 and takes in the result as a 3-bit signal for more detailed judgment on the jam portion.

In FIG. 5, which is an operation flow chart in the jam eliminating processing, first in step 140 the controller 82 judges a jam signal has been provided from the jam signal generator 80 and if the answer is affirmative, then in step 141 the controller turns off the motor 70 which is for the conveyance of sheet in the re-feed unit 50. Then, in step 142 the controller 82 judges whether the jam signal is Jam 3 or not and if the result is NO, judgment is made in step 143 as to whether the jam signal is Jam 2 or not. If the result of the judgment in step 143 is YES, then in step 144 there is made indication of Jam 2 on the indicator 84. On the other hand, if the result of the judgment in step 143 is NO, the controller 82 causes the indicator 84 to indicate Jam 1 in step 145 and thereafter execution returns to the main routine. If it is judged in step 142 that the jam signal is Jam 3, the controller 82 refers to the 3-bit signal indicating the state of the sensors S1, S3 and S4 which it has taken in through the jam signal generator 80 for more detailed judgment on the jam portion, and judges whether the said signal is "001" or not, that is, whether the sensors S1, S3 and S4 are OFF, OFF and ON, respectively or not. This is a judgement as to whether the rear end of the jam sheet is positioned in the spacing between the guide plates 54 and 55 which spacing is a sheet removable area. If the result of this judgment is YES, the controller 82 causes the indicator 84 to indicate Jam 3 immediately in step 147 and thereafter execution returns to the main routine. If the result of the judgement in step 146 is NO, it follows that the foregoing 3-bit signal is "010" or "110", that is, the sensors S1, S3 and S4 are OFF, ON and OFF, respectively or ON, ON and OFF, respectively. In these cases, the jam sheet completely gets into the passage in the re-feed unit 50 or into the passage formed between the guide plates 67 and 68 which passages are sheet unremovable areas of the secondary passage 69, so in step 148 the controller 82 causes the motor 70 to rotate in reverse to move the sheet in reverse toward the inlet of the re-feed unit 50. Then, judgment is made as to whether the sensor S4 is just turned on or not, and while the result of the judgment is NO, the processings of steps 148 and 149 are repeated to continue the reverse feed of the jammed sheet. And when the sensor S4 is turned ON by the rear end of the jammed sheet thus fed reverse, the controller 82 sets the timer T5 in step 150 which timer is provided in the interior of the controller. Then, when the count-up of the timer T5 is confirmed in step 151, the controller 82 turns OFF the motor in step 152. By the processings so far performed the rear end of the jam sheet is moved in reverse up to the spacing formed between the guide plates 54 and 55 which spacing is the foregoing removable area. Then, in step 153 the controller 82 causes the indicator 84 to indicate Jam 3 and execution returns to the main routine.

To sum up, when the sensor S1 does not turn OFF even upon count-up of the timer T1, or when the sensor S2 does not turn ON even upon count-up of the timer T2 after turning OFF of the sensor S1, it is judged that a jam Jam 1 occurred before or behind the sensor S1 or between the sensors S1 and S2. And when the sensor S2 does not turn OFF even upon count-up of the timer T3 after turning ON of the sensor S2, it is judged that a jam Jam 2 occurred before or behind the sensor S2. Thus, in the event of jams (Jam 1) and (Jam 2), these jams are occurring in the primary passage 44, so the operator opens the upper body 12 of the copying machine body 10 as shown in FIG. 2 to open the primary passage 44, whereby the sheet indicated at Sa in FIG. 2 can be removed. The indicator 84 indicates to this effect alone.

Further, when the sensor S1 does not turn ON even upon count-up of the timer T4 after turning ON of the sensor S4, it is judged that a jam (jam 3) occurred in the secondary passage 69. In this case, the motor 70 rotates reverse whereby the jammed sheet is moved back until its rear end reaches the spacing between the guide plates 54 and 55. Consequently, as shown in FIG. 2, the operator can open the guide plate 55 and remove the sheet indicated at Sb. Thus, it is no longer necessary to provide a special space for removing the sheet which is causing jam in the secondary passage 69 and so it is possible to afford a copying machine smaller in size.

Particularly, in the event of a jam, there trouble occurs at the front end of sheet, so if the sheet is further moved in the conveyance direction, the jam will be promoted, but in the present invention, the sheet rear end free of trouble is moved backward as the front end, so it becomes possible to return the jam sheet certainly up to a predetermined position and discharge it to the exterior easily from that position.

The image forming apparatus of the present invention is not limited to the above embodiment. Various modifications may be made within the scope of the gist of the invention. For example, the paired timing rollers 40 may be rendered capable of contacting with and moving away from each other so that in the case of reverse feed of the jam sheet in the secondary passage 69, the rollers 40 are moved away from each other, the load applied to the motor 70 when reverse rotated can be reduced even when the front end of the sheet has reached between the rollers 40.

Moreover, although in the above embodiment there is used the motor 70 for driving only the roller pairs 60, 61 and 62 located in the re-feed unit 50, there may be utilized a main motor (not shown) incorporated in the apparatus body 10 to drive those roller pairs. In this case, a mechanical clutch is used to rotate the roller pairs 60, 61 and 62 forward and reverse. In the illustrated apparatus, moreover, the guide plate 55 is opened to discharge a jammed sheet from the interior of the secondary passage 69 to the exterior, but the guide plate 64 or 66 may be opened for the same purpose.

Further, although the illustrated copying machine is for composite copying, the present invention is also applicable to both-side copying machines as previously noted.

What is claimed is:

1. An image forming apparatus for forming images on a single sheet a plural number of times by feeding the sheet again to an image forming unit after an image is formed on one side of the sheet by said image forming unit, said image forming apparatus including:

an apparatus body in which said image forming unit is incorporated, said apparatus body having a feeding unit which stores sheets to be fed into the image forming unit;

a sheet reversing unit, assembled with said apparatus body, having a discharge section, which receives sheets with images formed thereon;

a primary passage to guide each sheet from said feeding unit to said discharge section through said image forming unit;

a secondary passage branching from a downstream end of said primary passage in said sheet reversing unit and extending up to an upstream end of the said primary passage to guide each sheet which has passed said image forming unit again up to said image forming unit, said secondary passage in said sheet reversing unit having a sheet removing area which includes a guide plate capable of being opened to expose the interior of the secondary passage to the exterior of the sheet reversing unit to permit the removal of the sheet present in the interior;

a detecting means disposed in said secondary passage to detect a jammed sheet present in the secondary passage;

a re-feed unit disposed within said apparatus body, forming a port of said secondary passage and provided with a drive means for driving each sheet present in the secondary passage forward toward the upstream end of said primary passage and also driving it backward toward the downstream end of the primary passage; and a control means which controls said drive means so that when said detecting means detects a jam in the secondary passage of said re-feed unit, the jammed sheet is moved backward up to said sheet removing area in the said sheet reversing unit.

2. An image forming apparatus according to claim 1, wherein said detecting means comprises a plurality of jam detecting sensors disposed in said secondary passage, and said control means detects a jam position in said secondary passage in accordance with any of said sensors which has detected a jam.

3. An image forming apparatus comprising:

a machine body having an image forming section for forming an image on a sheet and a feeding section for feeding the sheet to the image forming section;

a sheet reversing unit attached to said machine body for receiving from said machine body the sheet with the image formed thereon, and said sheet reversing unit having a discharge section for discharging the sheet received from said machine body;

a primary passage to guide the sheet from said feeding section to said discharge section through said image forming section;

a secondary passage branching from a downstream end of said primary passage in said sheet reversing unit and extending up to an upstream end of the primary passage to guide the sheet up to said image forming section again, said secondary passage in said sheet reversing unit having a sheet removing area which includes a guide plate capable of being opened to expose the interior of the secondary passage to the exterior of the sheet reversing unit in order to permit the removal of the sheet present in the interior;

a detecting means including a plurality of jam detecting sensors disposed in said secondary passage for detecting a jam in the secondary passage;

a re-feed unit disposed within said machine body, forming a part of said secondary passage and provided with a drive means for driving the sheet present in the secondary passage forward toward the upstream end of said primary passage and also driving it backward toward the downstream end of the primary passage; and a control means, responsive to said detecting means, for determining a jam position in said secondary passage and for controlling said drive means so as to move the jammed sheet backward up to said sheet removing area in said sheet reversing unit when the determined jam position is in said re-feed unit.

* * * * *